United States Patent [19]

Watanabe

[11] 4,275,106

[45] Jun. 23, 1981

[54] TRANSFER SHEET FOR POLYAMIDE ARTICLES

[75] Inventor: Tadao Watanabe, Tokyo, Japan

[73] Assignee: Toppan Printing Co., Ltd., Japan

[21] Appl. No.: 955,949

[22] Filed: Oct. 30, 1978

[30] Foreign Application Priority Data

Nov. 1, 1977 [JP] Japan ..... 52/131363

[51] Int. Cl.[3] ..... B41M 3/12

[52] U.S. Cl. ..... 428/200; 156/240; 156/249; 428/202; 428/207; 428/209; 428/344; 428/349; 428/355; 428/913; 428/914

[58] Field of Search ..... 156/234, 240, 249, 277; 427/148; 428/200, 202, 204, 207, 211, 347, 349, 352–355, 913, 914, 209, 344

[56] References Cited

U.S. PATENT DOCUMENTS

| | | | |
|---|---|---|---|
| 2,746,877 | 5/1956 | Matthes | 428/200 |
| 3,516,904 | 6/1970 | Klinker | 156/234 X |
| 3,922,435 | 11/1975 | Ashes | 156/240 X |
| 4,012,552 | 3/1977 | Watts | 427/148 X |
| 4,068,033 | 1/1978 | Meade | 428/201 |
| 4,117,182 | 9/1978 | Andrews | 427/148 X |

*Primary Examiner*—Bruce H. Hess

*Attorney, Agent, or Firm*—Lerner, David, Littenberg & Samuel

[57] ABSTRACT

A transfer sheet which is used for transferring designs on to the surface of articles made of polyamide resin. The transferred design on the polyamide articles are excellent in appearance, durability and adhesiveness to the polyamide surfaces. The transfer sheet is basically composed of a backing material, a design layer and an adhesive layer and the invention is characterized in that said adhesive layer contains a varnish which is composed of: (A) nitrocellulose and (B) one member or a mixture of more members selected from the group consisting of phthalic ester plasticizers, fatty acid ester plasticizers, phosphoric ester plasticizers, epoxy plasticizers, alkyd resins and maleic acid resins.

16 Claims, 12 Drawing Figures

TRANSFER SHEET FOR POLYAMIDE ARTICLES

BACKGROUND OF THE INVENTION (1) Field of the Invention

This invention relates to a transfer sheet. More particularly, the invention relates to a transfer sheet or a decalcomania for use in transferring pictures and designs to the surfaces of articles which are made of polyamide.

Polyamide resin is a polymer having amide bonds in its main chain and prepared by the polycondensation of diamines and dibasic acids, the ring opening-polymerization of lactams or the polycondensation of aminocarboxylic acids. The articles to receive transferred designs thereon are made by forming the above resin through blow molding, extrusion and injection molding. The transferring means that some designs are printed on base materials such as paper and then only the printed ink layers of designs are transferred on to the surfaces of articles by closely fitting the transfer sheets to the articles and heating under pressure.

(2) Description of the Prior Art

When designs are applied to the surfaces of polyamide articles in the conventional art, the direct methods such as silk screen printing, dry offset printing and so forth are employed. In these direct printing methods, however, the printing presses used for the methods are expensive, high printing techniques are required and large floor areas for equipments are necessary. Therefore, such methods are suitable for mass production. Further, in some cases, printed labels are applied to the surfaces of molded articles. However, it is defective in that the stuck labels are not durable against water and rubbing, and are liable to be peeled off.

In order to solve such the problems, the aforementioned design transferring method has been employed. In the transferring method, the transfer sheet has generally a thermosensitive adhesive layer which becomes adherent to the surface of article when heated.

However, there has been no adhesive which is adherent to polyamide resin. The ink used in the common direct printing method is tightly bonded to the surfaces of molded articles since reactive resins and curing agents are employed and reaction is caused to occur after the printing. When a non-reactive resin is used, sufficient strength or duability of the printed design cannot be expected. In the case of the transfer sheet, the reactive resin cannot be preserved in the form of rolled sheet to be used, therefore, the transfer sheet which gives sufficiently stron transferred designs has never been obtained.

BRIEF SUMMARY OF THE INVENTION

In view of the above disadvantages in the conventional art, the present invention has been accomplished by the inventors of the present application after carrying out a wide variety of studies and investigations.

It is, therefore, the primary object of the present invention to provide an improved transfer sheet which is free from the above-described defects.

Another object of the present invention is to provide a transfer sheet which is useful for producing transferred pictures and designs on the surfaces of molded articles made of polyamide resin.

A further object of the present invention is to provide a transfer sheet which forms transferred designs on the polyamide molded articles with sufficient adhesive strength.

Still a further object of the present invention is to provide a transfer sheet which can be produced without difficulty and preserved for a long time in practical uses.

In order to attain the above objects of the present invention, various kinds of resins have been tested in connection with the adhesiveness by heat and pressure relative to the polyamide resin. As the result, it has been found that the adhesive composition of the present invention shows a quite good adhesive strength by heating under pressure even though it does not exert the adhesive strength by the application of solvent evaporation type just like the common printing method, thereby accomplishing the present invention.

In accordance with the present invention, the adhesive layer of the transfer sheet contains a varnish which is composed of nitrocellulose and one member or a mixture of the group consisting of phthalic ester plasticizers, fatty acid ester plasticizers, phosphoric ester plasticizers, epoxy plasticizers, alkyd resins and maleic acid resins.

According to further aspect of the present invention, the above varnish is composed of 30 to 90 parts of weight of the nitrocellulose and 70 to 10 parts by weight of the above-mentioned plasticizers or resins.

BRIEF DESCRIPTION OF THE DRAWINGS

The nature, principle and details of the present invention will become more apparent to those skilled in the art from the following detailed description with respect to preferred embodiments of the invention with the accompanying drawings, in which.

DETAILED DESCRIPTION OF THE INVENTION

Figure 1:
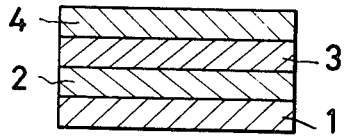
FIGS. 1 to 12, inclusive, are partially enlarged cross-sectional views of the embodiments of the transfer sheets of the present invention.

The present invention has been made since quite desirable results were obtained when a certain adhesive layer was formulated. Such the adhesive layer contained a varnish which was composed of (A) nitrocellulose and (B) a member or a mixture of the group consisting of phthalic ester plasticizers, fatty acid ester plasticizers, phosphoric ester plasticizers, epoxy plasticizers, alkyd resins and maleic acid resins, as described in the foregoing. This varnish may be further mixed with thermoplastic urethane and vinyl chloride copolymer.

The nitrocellulose used for preparing the above varnish, has a degree of nitration of 10 to 14%, a degree of polymerization of 40 to 450 and a specific gravity of 1.5 to 1.6. Exemplified as the preferable plasticizers to be added are phthalic ester plasticizers such as dioctyl phthalate and dibutyl phthalate, fatty acid ester derivative plasticizers such as butyl oleate, phosphoric ester plasticizers such as tricresyl phosphate and triphenyl phosphate, and epoxy plasticizers such as epoxydized soy bean oil and octyl epoxy stearate. Good results have been obtained when the plasticizers are used both solely and combinedly. Further, exemplified as the above resins are alkyd resins such as acryl-modified alkyd resin and castor oil-modified alkyd resin and maleic acid resin such as rosin-modified maleic acid resin. Good results as above can also be obtained when these resins are used solely and combinedly with the above plasticizers. These plasticizers and resins are suffice for obtaining good adhesiveness, however, polyvinyl chloride polymer such as vinyl acetate-vinyl alcohol copolymer and one component type urethane resin can be added to the above materials as fillers, by which the fitting property and durability are improved and the blocking can be prevented. When the plasticizers and/or maleic acid resin and alkyd resin are mixed into the main component of nitrocellulose, if the percentage of nitrocellulose is low, the adhesive strength becomes large and the mixture spreads well, however, the blocking is caused to occur when the transfer sheet is rolled up since the adherence of printed surfaces becomes intense. If the compounding ratio of nitrocellulose is high, the adhesiveness is weakened while the hardness is raised so that the blocking is hardly caused to occur when the product is rolled up. In view of the above, the compounding ratio of nitrocellulose is preferably in the range of 30 to 90 parts by weight per 70 to 10 parts by weight of the above-mentioned plasticizers, alkyd resin and maleic acid resin. Even when the ratios and kinds of added plasticizers and the above resins are varied, if the total quantity of them comes within the above range relative to the nitrocellulose, good results can be obtained likewise.

In the case that one or the mixture of the above-mentioned vinyl chloride copolymer and urethane resin is added, when the addition quantity is increased, the blocking property in the rolling of the transfer sheet is remedied and the water resistance and chemical resistance are improved, however, if they are added to excess, the adhesiveness becomes worse. In view of the above, the addition quantity of them may be within the range of 5 to 60 parts by weight to 100 parts by weight of the above varnish.

The transfer sheet of the present invention can be provided with some other layers in addition to the basic layers of a backing material, a design layer and an adhesive layer. For example, a release layer is interposed between the backing material and the design layer. Further, an under coating layer is formed between the above release layer and the backing material. Still further, an intermediate layer is formed between the design layer and the release layer or the design layer and the adhesive layer.

The embodiments of the transfer sheets of the present invention are shown in the accompanying drawings, FIGS. 1 to 8 in partially enlarged cross-sectional views.

(1) That is, the transfer sheet shown in FIG. 1 is formed by putting several layers together in the order of a backing material 1, a release layer 2, a design layer 3 and an adhesive layer 4.

Figure 2:
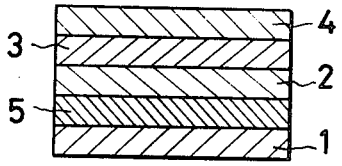

(2) The transfer sheet shown in FIG. 2 is formed by putting the layers together in the order of a backing material 1, an under coating layer 5, a release layer 2, a design layer 3 and an adhesive layer 4.

Figure 3:
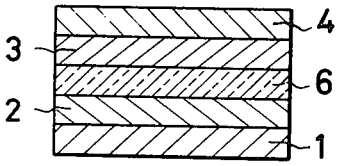
Figure 4:
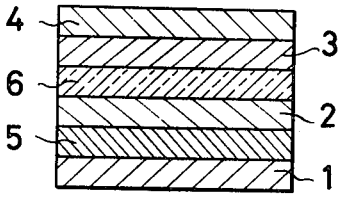

(3) The transfer sheet shown in FIG. 3 is formed by putting the layers together in the order of a backing material 1, a release layer 2, an intermediate layer 6, a design layer 3 and an adhesive layer 4.

Figure 5:
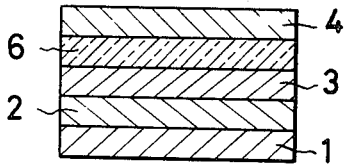

(4) The transfer sheet shown in FIG. 5 is formed by putting the layers together in the order of a backing material 1, an under coating layer 5, a release layer 2, an intermediate layer 6, a design layer 3 and an adhesive layer 4.

(5) The transfer sheet shown in FIG. 5 is formed by putting the layers together in the order of a backing material 1, a release layer 2, a design layer 3, an intermediate layer 6 and an adhesive layer 4.

Figure 6:
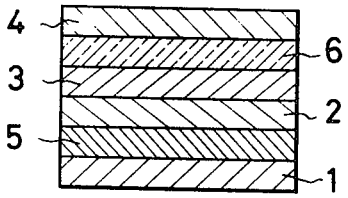

(6) The transfer sheet shown in FIG. 6 is formed by putting the layers together in the order of a backing material 1, an under coating layer 5, a release layer 2, a design layer 3, an intermediate layer 6 and an adhesive layer 4.

Figure 7:
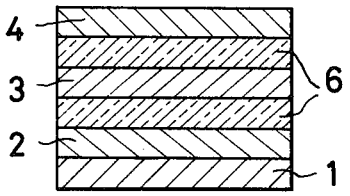

(7) The transfer sheet shown in FIG. 7 is formed by putting the layers together in the order of a backing material 1, a release layer 2, an intermediate layer 6, a design layer 3, another intermediate layer 6 and an adhesive layer 4.

Figure 8:
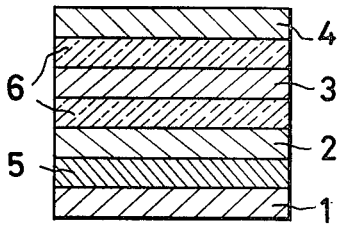

(8) The transfer sheet shown in FIG. 8 is formed by putting the layers together in the order of a backing material 1, an under coating layer 5, a release layer 2, an intermediate layer 6, a design layer 3, an intermediate layer 6 and an adhesive layer 4.

Further, between the design layer 3 and the adhesive layer 4, a vacuum deposition under coating layer 7, a vacuum deposition metallic layer 8 and an anchor coating layer 9 may be interposed. For example, some embodiments of them are shown in FIGS. 9 to 12 by partially enlarged cross-sectional views.

Figure 9:
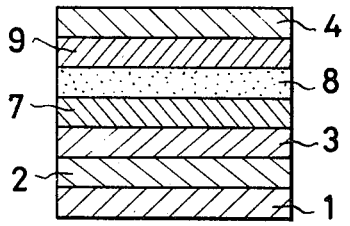

(9) That is, the transfer sheet shown in FIG. 9 is formed by putting the layers together in the order of a backing material 1, a release layer 2, a design layer 3, a vacuum deposition under coating layer 7, a vacuum deposition metallic layer 8, an anchor coating layer 9 and an adhesive layer 4.

Figure 10:
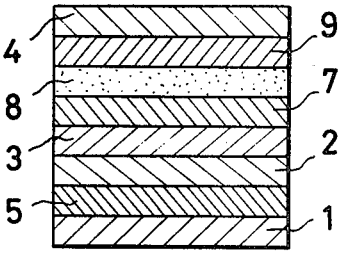

(10) The transfer sheet shown in FIG. 10 is formed by putting the layers together in the order of a backing material 1, an under coating layer 5, a release layer 2, a design layer 3, a vacuum deposition under coating layer 7, a vacuum deposition metallic layer 8, an anchor coating layer 9 and an adhesive layer 4.

Figure 11:
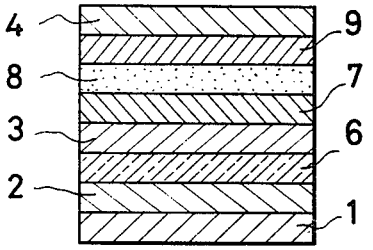

(11) The transfer sheet shown in FIG. 11 is formed by putting the layers together in the order of a backing material 1, a release layer 2, an intermediate layer 6, a design layer 3, a vacuum deposition under coating layer 7, a vacuum deposition metallic layer 8, an anchor coating layer 9 and an adhesive layer 4.

Figure 12:
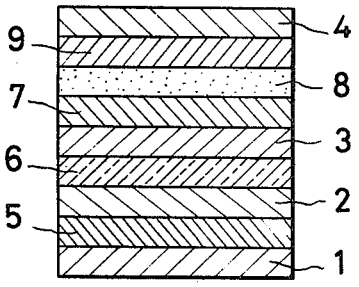

(12) The transfer sheet shown in FIG. 12 is formed by putting the layers together in the order of a backing material 1, an under coating layer 5, a release layer 2, an intermediate layer 6, a design layer 3, a vacuum deposition under coating layer 7, a vacuum deposition metallic layer 8, an anchor coating layer 9 and an adhesive layer 4.

As described above, the transfer sheet of the present invention can be composed of a various kinds of layer structures. However, it should be noted that the above-exemplified structures are given only for the purpose of illustration of the present invention and the scope of the present invention is not restricted to the above ones.

In the following, each layer will be further described in detail.

(A) Backing Material

It is necessary that the backing material of the transfer sheet is thermally resistant, low in thermal shrinkage and have smooth surfaces. For example, regenerated cellulose films and polyester films may be used. Further, when paper is used, the surface of paper is coated with a synthetic resin so as to give surface smoothness and the coated surface in printed. For example, paper is coated with alkyd resin together with a reactant such as isocyanate and it is then cured by heated. Further, the coating with a polyolefin such as polypropylene and the coating with polyester resin can also be employed.

(B) Release Layer

As the release layer, the resins which have no adhesive property relative to the above-mentioned backing material may be employed. Further, suitable slip agents and lubricants can be added to the above resins.

Exemplified as the resins having no adhesive property to the backing material are:

Chlorinated rubber
(Chlorine content: not less than 60% and molecular weight: 4,000-200,000)

Thermoplastic acrylic resin
(Copolymers mainly composed of methacrylic esters such as methacrylic ester itself, for example, methyl methacrylate, methacrylic ester-acrylic ester copolymer, and methacrylic ester-styrene copolymer)

Chlorinated polyolefin
(Chlorinated polyethylene of 60% or more in chlorine content and chlorinated polypropylene of 60% or more in chlorine content)

Vinyl resin
(Copolymers containing vinyl chloride as the main constituent such as vinyl chloride-vinyl acetate copolymer and vinyl chloride-vinyl acetate-polyvinyl alcohol copolymer)

Cellulose resin
(Cellulose derivatives such as cellulose acetate butyrate, cellulose propionate and nitrocellulose), and Cyclized rubber
(Resinous material which is prepared by cyclizing natural rubber).

The above-mentioned resins are used for the release layer. Further, two or more of compatible ones of the above resins may also be used by mixing together.

Examples of mixing:

Chlorinated rubber—thermoplastic acrylic resin, chlorinated rubber—chlorinated polyolefin, thermoplastic acrylic resin—chlorinated polyolefin, thermoplastic acrylic resin—vinyl resin, thermoplastic acrylic resin—cellulose resin, chlorinated rubber—thermoplastic acrylic resin—chlolinated polyolefin, and thermoplastic acrylic resin—vinyl resin—cellulose resin.

Further, exemplified as the additives for the release layer are polyethylene wax (low molecular weight polyethylene) and fatty acid amide (stearic acid amide and beef tallow amine, etc.). The releasing property can be improved by adding 0.1 to 15 parts of these additives to 100 parts of the film forming component. Furthermore, by adding 0.5 to 30 parts of extender pigments (silicon oxide, clay, barium sulfate, etc.) to 100 parts of the film forming component, the wear resistance of the surfaces of transferred designs can be improved.

(C) Design Layer

The design layer is composed of a film forming component (resin) and coloring pigment. The resin used for this design layer may be either the same resin as that of the release layer or other resins which have adhesiveness to the release layer. Since there exist the release layer (and the intermediate layer or other layers) between the transferred design layer and the surface of an article to receive the design layer, the design layer does not exert any influence on the physical property of the article. The printing of the design layer can be carried out by any printing method, for example, silk-screen process or gravure printing process. When gravure printing process is employed, continuous tone pictures can be printed.

(D) Adhesive Layer

The adhesive layer is composed of the following materials as described in the foregoing. That is, the adhesive layer is composed of a varnish which consists of (a) nitrocellulose and (b) a member or a mixture of phthalic ester plasticizers, fatty acid ester plasticizers, phosphoric ester plasticizers, epoxy plasticizers, alkyd resins and maleic acid resins. Further, thermoplastic urethane and vinyl chloride copolymer can be added to the above varnish.

The nitrocellulose used for the preparation of the above varnish has a degree of nitration of 10 to 14%, a degree of polymerization of 40 to 450 and a specific gravity of 1.5 to 1.6. Exemplified as the preferable plasticizers to be added are phthalic ester plastixizers such as dioctyl phthalate and dibutyl phthalate, fatty acid ester derivative plasticizers such as butyl oleate, phosphoric ester plasticizers such as tricresyl phosphate and triphenyl phosphate and epoxy plasticizers such as epoxydized soy bean oil and octyl epoxy stearate. Good results can always be obtained when the plasticizers are used both solely and combinedly. Further, exemplified as the above resins are alkyd resins such as acryl-modified alkyd resin and castor oil-modified alkyd resin and maleic acid resin such as rosin-modified maleic acid resin. Good results as above can also be obtained when these resins are used solely and combinedly with the above-mentioned plasticizers. These plasticizers and resins are sufficient for obtaining good adhesiveness, however, polyvinyl copolymer such as vinyl acetate-vinyl alcohol copolymer and one component type urethane resin can be added to the above materials as fillers, by which the fitting property and durability are improved and the blocking can be prevented. When the plasticizers, maleic acid resin and alkyd resins are mixed, if the content of nitrocellulose is small, the adhesiveness becomes large and the mixture spreads well, however, the blocking is caused to occur when the transfer sheet is rolled up since the adherence of printed surfaces become intense. If the compounding ratio of the nitrocellulose is high, the adhesiveness is weakened while the hardness is raised so that the locking is hardly caused to occur when the product is rolled up. In view of the above, the compounding ratio of the nitrocellulose is preferably in the range of 30 to 90 parts by weight per 70 to 10 parts by weight of the above-mentioned plasticizers, alkyd resin and maleic acid resin. Even when the ratios and kinds of the added plasticizers and resins are varied, if the total quantity of them comes within the above range relative to the quantity of the nitrocellulose, good results can be obtained likewise.

In the case that one member or the mixture of the above-mentioned vinyl chloride copolymer and urethane resin is added, when the addition quantity is increased, the blocking property in the rolling of the transfer sheet is remedied and the water resistance and chemical resistance are improved, however, if they are added to excess, the adhesiveness becomes worse. In view of these, the addition quantity of them may be within the range of 5 to 60 parts by weight to 100 parts by weight of the above varnish.

(E) Under Coating Layer

The under coating layer is left on the side of the backing material in the transferring operation. Accordingly, the material for the under coating layer have adhesiveness to the backing material and, in addition, the property to improve the releasing from the release layer in the transferring operation. Exemplified as such a resins are polyethylene glycol having a molecular weight of 200 to 10,000 and microcrystalline wax.

(F) Intermediate Layer

This intermediate layer is provided in order to improve the surface property of transferred design. This layer is formed between the release layer and the design layer or the design layer and the adhesive layer, as occasion demands. The design layer is generally formed only in the necessary design portions so that the intermediate layer must have good adhesiveness in connection with any of the release layer, design layer and adhesive layer.

The suitable resins for use as the materials of the intermediate layer are the same resins as those for the above-described release layer other than the one which is used for forming the release layer itself. In addition to the above, urethane resin, alkyd resin, and acrylonitrilebutadiene-sytrene copolymer can be used as the resin materials which have adhesiveness to both the release layer and the adhesive layer.

(G) Vacuum Deposition Under Coating Layer

The vacuum deposition under coating layer is required only when the vacuum deposition metallic layer is formed. This vacuum deposition under coating layer is formed for the purpose of avoiding the influence of vacuum deposition metallic layer on the design layer, unifying the surface to be deposited and forming good and smooth vacuum deposition metallic layer.

As the materials for this vacuum deposition under coating layer, the materials for the primer layers in the ordinary metallic vacuum deposition can be used, however, the materials in this invention must be selected in view of the adhesiveness to the release layer and the design layer. Exemplified as such resins are nitrocellulose, acrylic resin such as methyl methacrylate, polyesters, and polyvinyl chloride.

(H) Vacuum Deposition Metallic Layer

The vacuum deposition metallic layer is formed by depositing the vapor of a metal such as aluminium in vacuum. The thickness of deposition layer is about 300 Å to 700 Å, and the vacuum deposition may be effected partially or totally.

(I) Anchor Coating Layer

The anchor coating layer is formed for the purpose of joining the vacuum deposition metallic layer and the adhesive layer. In the present invention, a special varnish is employed as the adhesive layer which has good adhesiveness to polyamide articles to receive transferred designs as described in the foregoing, however, this varnish is not so adhesive to the vacuum deposition metallic layer, therefore, even if the adhesive layer is formed directly on the vacuum deposition layer, a practically acceptable transfer sheet cannot be obtained. Accordingly, the anchor coating layer must have adhesiveness to both the vacuum deposition metallic layer and the adhesive layer. Exemplified as such resins are polyester, polystyrene, vinyl resin, acrylic resin or their mixture.

The transfer sheets shown in FIGS. 1 to 12 are produced by forming each of the above layers on the backing material. The layers other than the vacuum deposition metallic layer can be formed by coating method or a suitable printing method such as gravure printing process.

By the way, when the articles to receive transferred designs are flexible ones such as nylon-made tubes, all the layers to be transferred to the surfaces of articles such as the release layer, design layer, adhesive layer, intermediate layer, vacuum deposition under coating layer and vacuum deposition metallic layer and anchor layer must have sufficient durability against the flexion of the articles.

By using the transfer sheets of the present invention having the above-described structure, durable transferred designs can be formed on the surfaces of articles which have their surfaces made of polyamide resin. In addition the blocking is not caused to occur during the storage of the transfer sheets. Further, if the vacuum deposition layer is formed, metallic luster is given to the transferred designs.

EXAMPLE 1

A backing material made of polyester film was used and the surface of the film was applied with a releasing agent 1 to form a release layer and it was dried.

Releasing agent 1:
Chlorinated rubber—20 parts
Fatty acid amide—1 part
Toluene—80 parts Then, an ink 1 was applied to form a design layer and the layer was dried.

Ink 1:
Chlorinated rubber—20 parts
Pigment—5 parts
Toluene—80 parts

After that an adhesive agent 1 was applied to form an adhesive layer and the layer was dired, thereby obtaining a transfer sheet.

Adhesive agent 1:
Nitrocellulose—18 parts
Epoxy plasticizer—6 parts
Aclyl-modified alkyd resin—6 parts
Ethyl acetate—30 parts
Isopropyl alcohol—20 parts
Toluene—50 parts

EXAMPLE 2

A backing material was prepared by applying 21 $g/m^2$ of polypropylene resin on glassine paper (35 $g/m^2$) by extrusion coating. A releasing agent 2 was applied on the backing material to form a release layer and the layer was dried.

Releasing agent 2:
Chlorinated rubber—15 parts
Chlorinated polypropylene—5 parts
Toluene—80 parts Then a design layer was formed by using the ink 1 and the layer was dried. Further, an adhesive agent 2 was applied thereon to form an adhesive layer and dried, thereby forming a transfer sheet.

Adhesive agent 2:
Nitrocellulose—16 parts
Dioctyl phthalate—2 parts
Maleic acid resin—5 parts
Alkyd resin—4 parts
Ethyl acetate—30 parts
Isopropyl alcohol—20 parts
Toluene—50 parts

EXAMPLE 3

On a backing material of polyester film (thickness: 25 microns), the releasing agent 1 was applied to form a release layer and the layer was dried. Then, an intermediate layer varnish 1 was applied further to form an intermediate layer thereon and it was dried.

Intermediate layer varnish 1:

Cellulose acetate butyrate—15 parts
Thermoplastic acrylic resin—15 parts
Toluene—50 parts
Ethyl acetate—30 parts
Isopropyl alcohol—20 parts On the layered material that was formed in the above process, an ink 2 was applied to form a design layer and then dried.

Ink 2:

Chlorinate rubber—17 parts
Thermoplastic acrylic resin—4 parts
Pigment—4 parts
Toluene—75 parts Further, an adhesive layer was formed thereon by applying an adhesive agent 3 thereby obtaining a transfer sheet.

Adhesive agent 3:

Nitrocellulose—4.5 parts
Butyl oleate—4.5 parts
Linseed oil-modified alkyd resin—6 parts
Vinyl chloride-vinyl acetate copolymer—15 parts
Ethyl acetate—30 parts
Isopropyl alcohol—20 parts
Toluene—50 parts

EXAMPLE 4

Regenerated cellulose film was used as a backing material and it was applied with an under coating agent 1 to form an under coating layer.

Under coating agent 1:

Polyethylene glycol—2 parts
Water—70 parts
Ethyl alcohol—30 parts

Further, a releasing agent 3 was applied thereon to form a release layer and it was then dried.

Releasing agent 3:

Thermoplastic acrylic resin—15 parts
Vinyl chloride copolymer—15 parts
Toluene—80 parts
Ethyl acetate—20 parts Then an ink 3 was applied to form a design layer and it was dried.

Ink 3:

Nitrocellulose—17 parts
Solid alkyd resin—7 parts
Dioctyl phthalate—2 parts
Pigment—4 parts
Ethyl acetate—30 parts
Isopropyl alcohol—20 parts
Toluene—50 parts After that an adhesive agent 4 was applied to form an adhesive layer and it was dried, thereby obtaining a transfer sheet.

Adhesive agent 4:

Nitrocellulose—18 parts
Triphenyl phosphate—2 parts
Solid alkyd resin—5 parts
Urethane resin—5 parts
Ethyl acetate—30 parts
Isopropyl alcohol—20 parts
Toluene—50 parts The transfer sheets which were prepared in the above Examples 1, 2, 3 and 4 were heated to 220° to 250° C. and transferring was carried out to the surfaces of articles made of polyamide resin by using a silicone rubber roller. After that, the backing films were peeled off. As the results, all the transferred designs were quite good in these tests. The transferred designs were subjected to the following durability tests.

| Item | Test Method |
|---|---|
| Water resistance | Soaked in water for 1 hour at room temperature, then the state of adhesion and appearance were observed. |
| Detergent resistance | Soaked in 5% aqueous solution of a detergent for house cleaning, for 1 hour, then the state of adhesion and appearance were observed. |
| Adhesiveness | Pressure sensitive adhesive tapes were stuck to the design layer and then peeled off. The appearance was observed after that. |
| Light resistance | Irradiated with a fade meter for 48 hours and then the appearance was observed. |

EXAMPLE 5

A release layer, an intermediate layer, a design layer of ink and a vacuum deposition under coating layer were printed or coated in these order on a polyester film of 16 microns in thickness by using a rotary gravure press and gravure printing plates of 175 in ruling number and 35 microns in cell depth. The compositions that were used for the printing or coating of the respective layers are shown in the following:

Release layer:

Acrylic resin solution (solid content: 25%)—70 wt. parts
Toluene—30 wt. parts

Intermediate layer:

Chlorinated rubber-acrylic resin mixture solution (solid content: 25%)—70 wt. parts
Methyl ethyl ketone—20 wt. parts
Toluene—10 wt. parts Ink:

Nitrocellulose and alkyd resin—10 wt. parts
Pigment—5 wt. parts
Ethyl acetate—45 wt. parts
Methyl alcohol—25 wt. parts
Toluene—15 wt. parts Vacuum deposition under coating layer:

Nitrocellulose—15 wt. parts
Ethyl acetate—45 wt. parts
Methyl alcohol—25 wt. parts
Toluene—10 wt. parts After that, aluminium of 400 Å was vacuum-deposited on the surface of transparent resin layers by using a vacuum deposition machine under the conditions of a degree of vacuum of $2\times10^{-4}$ torr. and the distance from the aluminium crucible of 30 cm. Further, by using a rotary gravure press and gravure printing plates of 175 in ruling number and 35 micron depth, an anchor coating layer and an adhesive layer having the following compositions were formed.

Anchor coating layer:

Mixed solution of vinyl chloride-vinyl acetate copolymer and polyester—70 wt. parts
Ethyl acetate—30 wt. parts Adhesive layer:
Nitrocellulose resin—20 wt. parts
Alkyd resin—4 wt. parts
Plasticizer (dioctyl maleate ester)—6 wt. parts
Ethyl acetate—70 wt. parts Thus obtained transfer sheet was put on the surface of a tubular container having nylon surface and pressed by a silicone roller at a temperature of 250° C. and a speed of 6 cm/sec, then the backing material was peeled off. Through the above process, a nylon tube having both the design layer and vacuum deposition metallic layer was obtained.

EXAMPLE 6

A backing material of polyester film was applied with an under coating agent 2 to form an under coating layer and it was then dried.

Under coating agent 2:
Vinyl chloride-vinyl acetate copolymer—20 parts
One component type polyurethane—4 parts
Silicone—1 part
Toluene—50 parts
Ethyl acetate—25 parts Then it was applied with a releasing agent 4 to form a release layer and it was dried.

Releasing agent 4:
Nitrocellulose—18 parts
Methacrylic ester resin—7 parts
Toluene—30 parts
Acetic acid—25 parts
Isopropyl alcohol—20 parts After that, an intermediate layer varnish 1 was applied thereto to form an intermediate layer and dried. Further, with using the ink 2, a design layer was formed by printing and the adhesive agent 3 was further applied and dried to obtain a transfer sheet.

EXAMPLE 7

A backing material made of regenerated cellulose film was applied with the releasing agent 1 to form a release layer and it was dried. Then, a design layer was printed by using the ink 1. Further, an intermediate layer was formed by applying an intermediate layer varnish 2 and it was then dried.

Intermediate layer varnish 2:
Thermoplastic acrylic resin—22 parts
Chlorinated rubber—8 parts
Toluene—50 parts
Ethyl acetate—30 parts After that, the adhesive agent 1 was applied to the above, thereby forming a transfer sheet.

EXAMPLE 8

To a backing material made of polyester film, the under coating agent 2 was applied to form an under coating layer. Then, the releasing agent 4 was applied and dried, and further, a design layer was formed by printing it with the ink 3. After that, the intermediate layer varnish 1 was applied to form an intermediate layer and it was dried. Further, an adhesive layer was fomred by applying the adhesive agent 1, thereby obtaining a transfer sheet.

EXAMPLE 9

To a backing material made of polyester film, the releasing agent 1 was applied and it was then dried to form a release layer. Then, several layers were formed thereon by using the intermediate layer varnish 2, ink 3, intermediate layer varnish 3 and adhesive agent 2, thereby forming a transfer sheet.

EXAMPLE 10

On the backing material made of polyester film, several layers were formed in the order of an under coating layer with the under coating agent 2, a release layer with the releasing agent 4, an intermediate layer with the intermediate layer varnish 1, a design layer with the ink 3, again an intermediate layer with the intermediate layer varnish 1 and an adhesive layer with the adhesive agent 2, thereby forming a transfer sheet.

By using the transfer sheets prepared in the above Examples, clear and durable designs could be transferred on the surfaces of articles that were made of polyamide resin.

COMPARATIVE EXAMPLE 1

The conventional transfer sheets are practically used to the products made of polystyrene, polyvinyl chloride, acrylonitrile-butadiene-styrene copolymer and polyolefin. As the materials for the adhesive agents of these transfer sheets, acrylic esters, methacrylic esters, ethylene vinyl acetate, vinyl acetate and vinyl chloride-vinyl acetate copolymer are used. However, when these resins are used for transferring designs on the surfaces of polyamide resin articles, any desirable result cannot be obtained. This fact will be proved by the following comparative tests.

Backing materials of polyester films were applied with the releasing agent 1 and the ink 1 to form release layers and design layers. Then, several adhesive agents were prepared with using the above-mentioned resins. The above adhesive agents and the foregoing adhesive agent 1 were applied to the above layered sheets, respectively, thereby obtaining several kinds of transfer sheets. The designs of the transfer sheets were thermally transferred to the surfaces of molded articles made of polyamide resin (6-nylon) at the conditions of 200°C. and 10 cm/sec.

The test results are shown in the following table.

| Resin for adhesive layer | Transferring property | Adhesive tape resistance | Water resistance |
|---|---|---|---|
| Methacrylic ester | X | — | — |
| Acrylic ester | X | — | — |
| Ethylene vinyl acetate | Δ | 100/100 | X |
| Vinyl acetate | X | — | — |
| Vinyl chloride-vinyl acetate | Δ | 100/100 | X |
| Adhesive agent 1 | o | 0/100 | o |

As will be understood from the above results, the conventional transfer sheets have no adhesiveness to the polyamide resin. When the articles to receive transferred designs are made of low polarity resins, the suitable adhesive agents may also be of low polarity resins. However, the polyamide resin has a quite high polarity, so that the polar nitrocellulose is quite suitable.

When the nitrocellulose is solely used, the film property is not good so that it is not practically acceptable. However, it can be used by combining with plasticizers as described in the above.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A heat release decalcomania for polyamide articles comprising a backing material layer, a design layer comprising a film forming component and a coloring pigment, and an adhesive layer on said design layer, said adhesive layer consists essentially of (a) 30 to 90 parts by weight of nitrocellulose having a degree of nitration of from about 10 to about 14%, a degree of polymerization of from about 40 to about 450 and a specific gravity of from about 1.5 to about 1.6, and (b) 70 to 10 parts by weight of a member selected from the group consisting of phthalic ester plasticizers, fatty acid ester plasticizers, phosphoric ester plasticizers, epoxy plasticizers, alkyd resins, maleic acid resins and mixtures thereof.

2. A heat release decalcomania according to claim 1, further including in said adhesive layer from about 5 to about 60 parts by weight of thermoplastic urethane resin or vinyl chloride copolymer, per 100 parts by weight of said nitrocellulose and said member.

3. A heat release decalcomania for polyamide articles according to claim 1 wherein said backing material layer is comprised of a member selected from the group consisting of regenerated cellulose films, polyester films and paper coated with a synthetic resin.

4. A heat release decalcomania for polyamide articles according to claim 1 wherein a resinous release layer is formed between said backing layer and said design layer.

5. A heat release decalcomania for polyamide articles according to claim 4, wherein said release layer is comprised of a member selected from the group consisting of chlorinated rubber, thermoplastic acrylic resin, chlorinated polyolefin, vinyl resin, cellulose resin, cyclized rubber and mixtures thereof.

6. A heat release decalcomania for polyamide articles according to claim 4, wherein a resinous undercoating layer is formed between said backing layer and said release layer.

7. A heat release decalcomania for polyamide articles according to claim 6, wherein said undercoating layer is selected from the group consisting of polyethylene glycol having molecular weight of 200 to 10,000 and microcrystalline wax.

8. A heat release decalcomania for polyamide articles according to claim 4, wherein a resinous intermediate layer is formed between said release layer and said design layer.

9. A heat release decalcomania for polyamide articles according to claim 1, wherein a resinous intermediate layer is formed between said design layer and said adhesive layer.

10. A heat release decalcomania for polyamide articles according to claim 8 or 9, wherein said intermediate layer comprises a member selected from the group consisting of urethane resin, alkyd resin and acrylonitrile butadiene-styrene copolymer.

11. A heat release decalcomania for polyamide articles according to claim 1, wherein a resinous vacuum deposition undercoating layer and a vacuum deposition metallic layer are formed between said design layer and said adhesive layer.

12. A heat release decalcomania for polyamide articles according to claim 11, wherein said vacuum deposition undercoating layer is a member selected from the group consisting of nitrocellulose, acrylic resin, polyesters and polyvinyl chloride.

13. A heat release decalcomania for polyamide articles according to claim 11, wherein said vacuum deposition metallic layer is comprised of aluminium.

14. A heat release decalcomania for polyamide articles according to claim 11, wherein a resinous anchor coating layer is formed between said vacuum deposition metallic layer and said adhesive layer.

15. A heat release decalcomania for polyamide articles according to claim 14, wherein said anchor coating layer is comprised of a member selected from the group consisting of polyesters, polystyrene, vinyl resin, acrylic resin and mixtures thereof.

16. A heat release decalcomania for polyamide articles comprising a backing material layer, a design layer comprising a film forming component and a coloring pigment, an adhesive layer on said design layer, and a resinous vacuum deposition undercoating and a vacuum deposition metallic layer between said design layer and said adhesive layer, wherein said adhesive layer comprises (a) nitrocellulose having a degree of nitration of from about 10 to about 14%, a degree of polymerization of from about 40 to aboaut 450 and a specific gravity of from about 1.5 to about 1.6, and (b) a member selected from the group consisting of phthalic ester plasticizers, fatty acid ester plasticizers, phosphoric ester plasticizers, epoxy plasticizers, alkyd resins, maleic acid resins and mixtures thereof.

* * * * *

UNITED STATES PATENT AND TRADEMARK OFFICE

CERTIFICATE OF CORRECTION

PATENT NO. : 4,275,106

DATED : June 23, 1981

INVENTOR(S) : Tadao Watanabe

It is certified that error appears in the above-identified patent and that said Letters Patent are hereby corrected as shown below:

Column 2, line 24, "of" (second occurrence) should read --by--.

Column 4, line 66, "heated" should read --heating--.

Column 12, after line 53, insert the following:

--A sample of 10 x 10 mm was cut by parallel lines and perpendicular lines at 1 mm intervals with a knife, thereby forming 100 squares. A pressure sensitive adhesive tape was stuck to the cut aquares and the tape was then peeled off. The number of thus peeled squares from 100 squares were counted and indicated as the numerators.

Water resistance:

The transferred designs were soaked in water at 40°C for 24 hours and after that, the states of adhesion of the design layers were observed.

Evaluation:

X ..... Not good

Δ ..... A little bad o ..... Good --.

Signed and Sealed this

Third Day of November 1981

[SEAL]

Attest:

GERALD J. MOSSINGHOFF

Attesting Officer

Commissioner of Patents and Trademarks